United States Patent [19]

Simonazzi

[11] Patent Number: 4,721,138

[45] Date of Patent: Jan. 26, 1988

[54] CONTINUOUSLY ROTATING FILLING DEVICE WITH BOTTLE CONTROL MEANS

[76] Inventor: Adriano Simonazzi, via La Spezia 241/A, 43016 Parma, Italy

[21] Appl. No.: 925,589

[22] Filed: Oct. 31, 1986

[30] Foreign Application Priority Data

Nov. 11, 1985 [IT] Italy ..... 3599 A/85

[51] Int. Cl.[4] ..... B65B 3/04

[52] U.S. Cl. ..... 141/150; 141/372; 292/170

[58] Field of Search ..... 141/129–192, 141/250–284, 369–374; 292/170

[56] References Cited

U.S. PATENT DOCUMENTS 4,616,684 10/1986 Tincati ..... 141/372

FOREIGN PATENT DOCUMENTS 180242 3/1906 Fed. Rep. of Germany ..... 141/372

334026 8/1930 United Kingdom ..... 141/150

*Primary Examiner*—Houston S. Bell, Jr.

*Attorney, Agent, or Firm*—Sughrue, Mion, Zinn, Macpeak, and Seas

[57] ABSTRACT

A bottle filling machine having a rotatable head containing reservoir with a plurality of downwardly extending bottle engaging filling mechanisms is provided with a tappet vertically slidable in the head adjacent each bottle filling mechanism. Each tappet is provided with a prehensile bottle gripping device at the lower end thereof for gripping a bottle and a curved cam plate is provided for raising each tappet and the bottle held thereby to the bottle filling position whereupon the latch pin will be moved into engagement with a bore in the tappet to hold the tappet and bottle in filling position without the assistance of the cam plate. Upon completion of the filling operation the latch is released to allow the filled bottle to be lowered under the influence of gravity.

4 Claims, 6 Drawing Figures

CONTINUOUSLY ROTATING FILLING DEVICE WITH BOTTLE CONTROL MEANS

BACKGROUND OF THE INVENTION

The present invention is directed to a bottle filling machine having a continuously rotating filling device for filling each individual bottle in a group of bottles passing through the machine at very high speeds. More specifically, the present invention is directed to means for mechanically raising empty bottles into filling position while permitting filled bottles to be freely lowered.

Continuously rotating filling devices are old and well known in the art which are frequently provided with rotating filling nozzles which are disposed at a fixed height and small perforated reciprocating plates which engage the bottoms of the bottles for raising and lowering the bottles during the filling process.

Washing machines for bottles are also old and well known in the art which are provided with means for grasping each bottle by the neck and inverting it in synchronism with the washing process. Bottle filling machines are also known in the art which are provided with rotating filling devices which grasp the bottles by the neck and lift them towards the respective filling valves with molded guides attached to the frame of the machine. In this type of continuous rotating filling device, the molded guides are subjected to wear and tear due to the stress exerted on them by the elastic retraction means, springs or pneumatic jacks in addition to the pressure of the processing fluid and the weight of the frames which suspend the filled bottles.

SUMMARY OF THE INVENTION

The present invention provides a new and improved continuous rotating filling device which overcomes all of the shortcomings associated with the above described machines.

The present invention provides a new and improved bottle filling machine equipped with a continuous rotating filling device and means for mechanically raising empty bottles into filling position while permitting the filled bottles to be freely lowered.

The present invention provides a new and improved bottle filling machine equipped with a continuous rotating filling device and including resilient nozzle means extending from said device for engagement by the top of a bottle to be filled, tappet means slidably mounted for vertical reciprocating movement in said device adjacent said nozzle means, prehensile means secured to the lower end of said tappet means for engaging and supporting the bottles to be filled, abutment means on the opposite end of said tappet means to limit the downward movement of said tappet means, stationary guide means mounted below said device and engageable by the lower end of said tappet means for raising said tappet means and the bottle carried thereby to a filling position with the top of said bottle engaged with said nozzle means, latch means carried by said device for engagement with said tappet means to hold said tappet means in the raised bottle filled position and means for moving said latch means into and out of engagement with said tappet means in sychronism with the rotation of said device relative to said guide means whereby said tappet will be held in said raised bottle filled position only by said latch means during the filling operation and whereby said latch means will be disengaged from said tappet means upon completion of filling to permit the tappet means and the filled bottle carried thereby to be freely lowered.

The foregoing and other objects, features and advantages of the invention will be apparent from the following more particular description of a preferred embodiment of the invention as illustrated in the accompanying drawings.

DETAILED DESCRIPTION OF THE INVENTION

Figure 2:
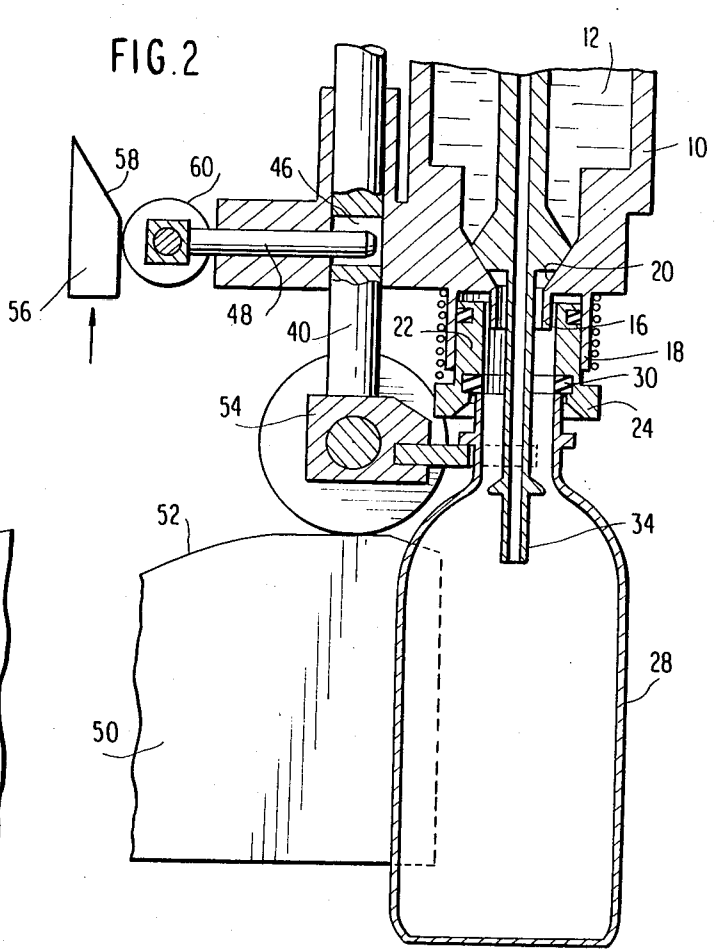
FIG. 2 is a view similar to FIG. 1 wherein the bottle has been raised to the filling position by means of a guide and the latch means has been brought into engagement with the tappet.

The general construction of bottle filling machines of the type having a continuously rotating filling device are old and well known in the art. The present invention resides in the improvement associated with each individual filling station on a continuously rotating filling device and accordingly only a single filling station will be described in detail hereinafter.

The continuously rotating filling device is comprised of a rotatable head portion 10 having a fluid reservoir 12 therein and a plurality of filling mechanisms 14, one of which is shown in the drawings, extending downwardly from the underside of the head portion. Each filling mechanism 14 includes a pair of annular concentric flanges 16 and 18 surrounding the fluid outlet aperture 20 which communicates the reservoir 12 with the filling mechanism 14. An annular sleeve 22 is slidably mounted within the flange 18 for vertical reciprocating movement and has a bell-shaped portion 24 on the lower end thereof adapted to engage the rim 26 of a bottle 28 and guide the rim 26 into sealing engagement with an annular sealing member 30 when the bottle 28 is raised into engagement with the filling mechanism 14. A spring 32 normally biases the sleeve 22 downwardly into engagement with a rim of the bottle when the bottle is raised into filling position. A vent tube 34 extends through the reservoir 12 and the filling mechanism 14 and is adapted to extend into the neck of the bottle 28 when the bottle is in filling position. The filling tube is provided with an enlarged valve portion 36 adapted to open and close the aperture 20 upon raising and lowering of the vent tube 34.

The tappet 40 is disposed parallel to each filling mechanism 14 and is slidably mounted in the head 10 for vertical reciprocating movement. A cap 42 is formed on or secured to the top end of the tappet 40 to limit the downward movement of the tappet 40 relative to the head 10. A prehensile bottle gripping device 44 is secured to the lower end of the tappet 40 for gripping the neck of the bottle 28. A transverse bore 46 extends through the tappet 40 perpendicular to the longitudinal axis of the tappet. A latch pin 48 extends through a bore in the head 10 for horizontal sliding movement into and out of engagement with the bore 46. The end of the pin 48 and the portion of the tappet surrounding the bore 46 may be provided with beveled surfaces to facilitate engagement of the pin and the bore. The prehensile gripping device on the lower end of the tappet is of conventional construction and it is not deemed necessary to illustrate or describe the gripping device in greater detail.

Figure 1:
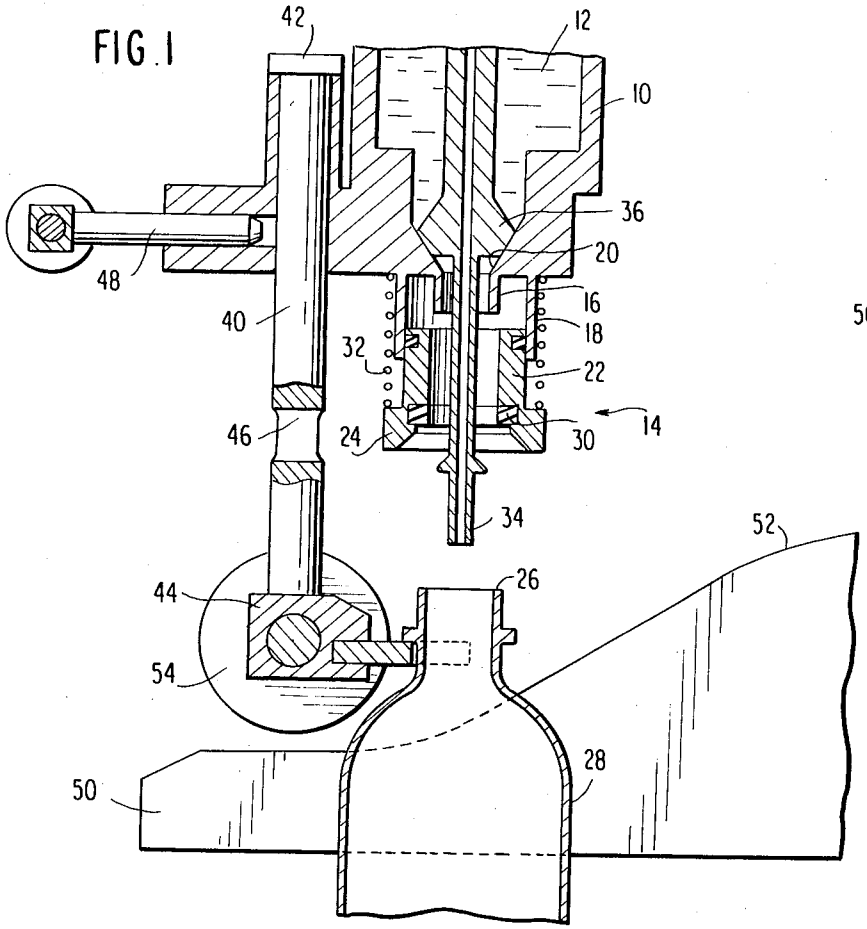
FIG. 1 is a side elevation view, partly in section, of the apparatus according to the present invention wherein a bottle held by the prehensile gripping means has not yet been raised to the filing position.

In order to raise a bottle 28 into contact with the filling device 14 a cam plate 50 having an upwardly curved cam surface 52 is mounted on the bottle filling machine at a fixed location. Each tappet 40 is provided with a roller 54 adapted to engage the cam surface 52 as the head portion 10 rotates relative to the fixed plate 50. As the roller 54 follows the upwardly curved cam surface 52 the tappet 40 and the bottle 28 carried thereby will move upwardly from the initial bottle gripping position, shown in FIG. 1, to the filling position shown in FIG. 2 wherein the rim of the bottle is disposed in sealing engagement with the filling mechanism 14. At this moment a cam finger 56 having a beveled surface 58 is moved upwardly into engagement with the roller 60 secured on the outer extremity of the latch 48 to shift the latch pin 48 into engagement with the bore 46. Thus upon continued rotation of the head 10 the roller 54 will move out of engagement with the cam surface 52 so that the tappet 40 and the bottle 28 carried thereby will be supported solely by means of the latch pin 48.

Figure 4:
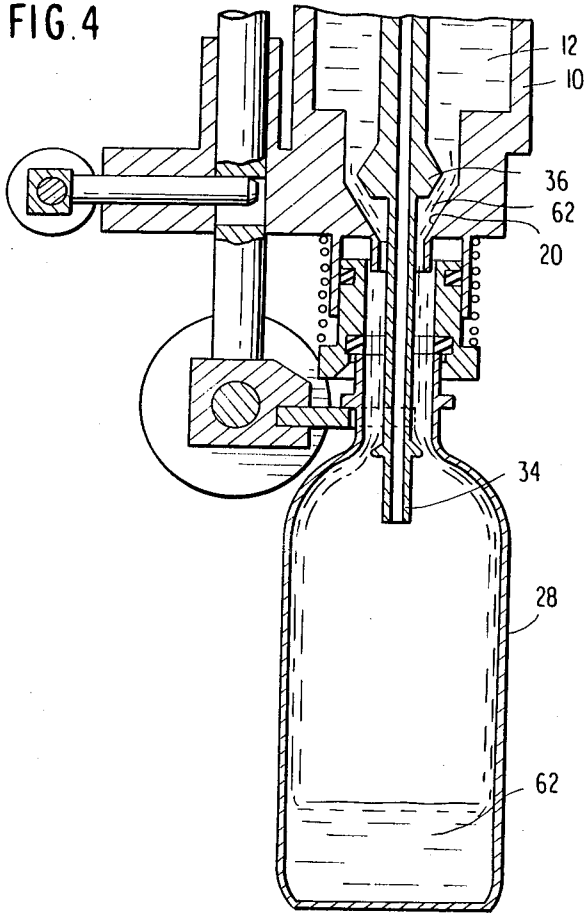
FIG. 4 is a view similar to FIG. 3 with the valve open during a filling operation.
Figure 3:
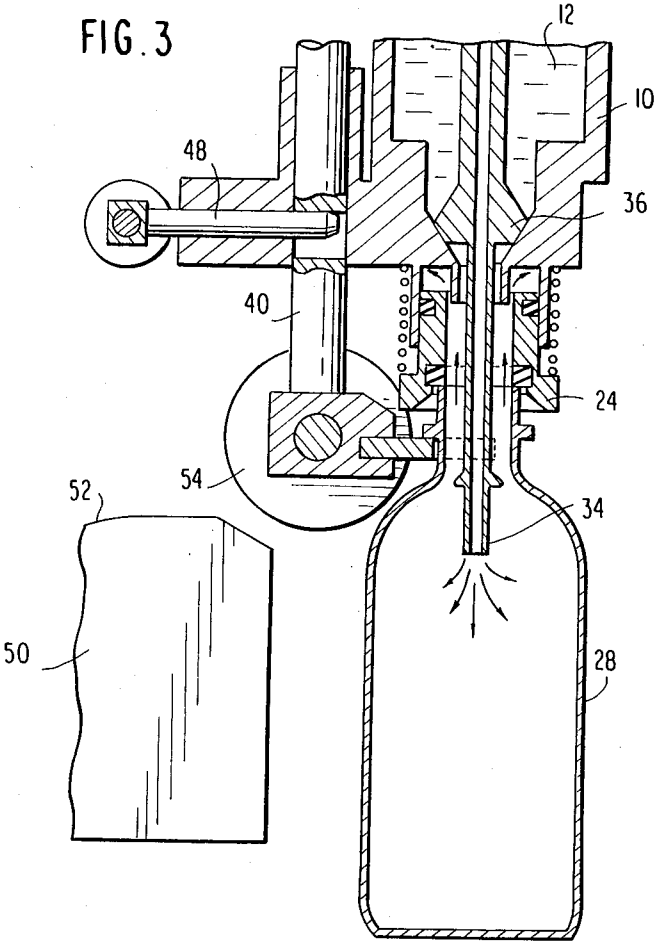
FIG. 3 is a view similar to FIG. 2 wherein the tappet and the bottle carried thereby are supported solely by the latch.
Figure 6:
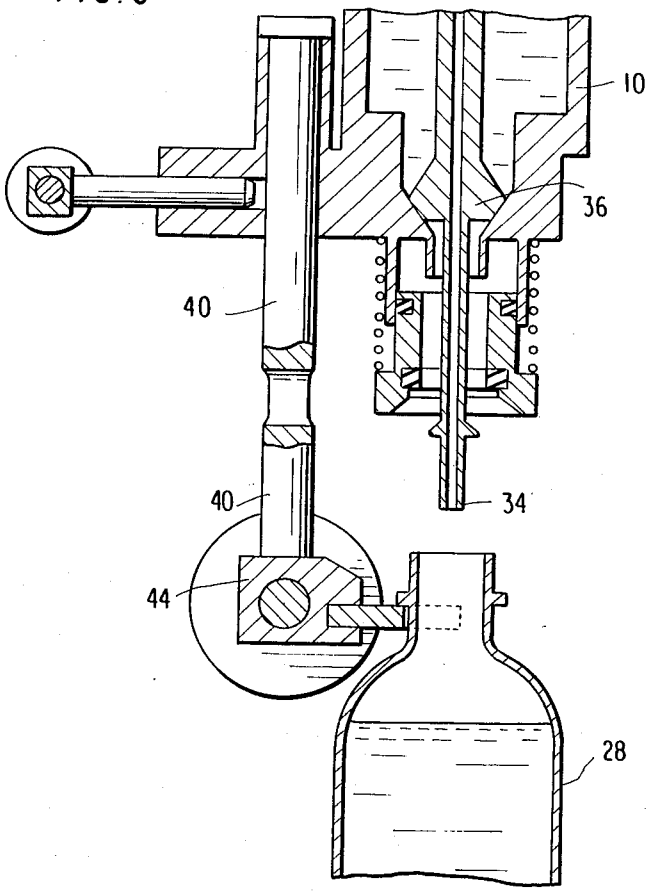
FIG. 6 is a view similar to FIG. 5 with the tappet and the filled bottle disposed in the lowermost position.
Figure 5:
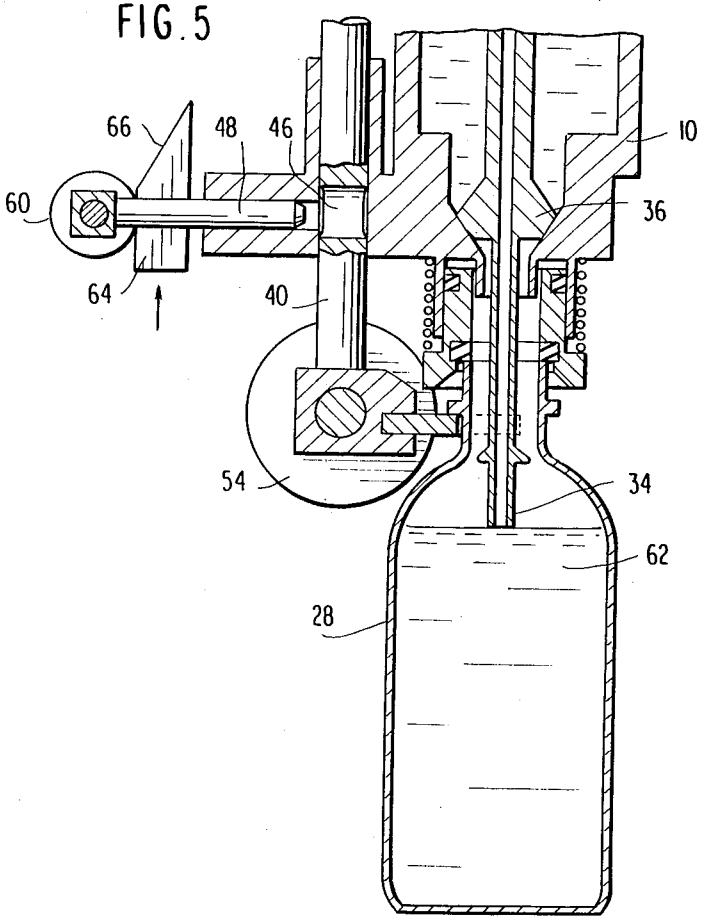
FIG. 5 is a view similar to FIG. 4 showing the latch out of engagement with the tappet upon conclusion of the filling operation.

At this time the filling process begins, as shown in FIG. 3, with the introduction of a gas through the filling tube 34 as shown by the arrows. Subsequent to the introduction of the gas in FIG. 3 the filling tube 34 is raised as shown in FIG. 4 by conventional means for opening the valve 36 to allow the flow of fluid 62 through the aperture 20 into the bottle. As the fluid 62 rises in the bottle the gas will be displaced outwardly through the vent tube 34 until such time as the fluid 62 reaches the bottom of the vent tube, as shown in FIG. 5. At this time the vent tube 34 is moved downwardly by conventional means to close the valve 36 thereby terminating the filling operation. Simultaneously with the closing of the valve 36, a cam finger 64, having a beveled upper surface 66, is moved upwardly into engagement with the roller 60 on the end of the latch pin 48 to force the latch pin to the left, as viewed in FIG. 5, so that the latch pin will be moved out of engagement with the bore 46 in the tappet 40. Since the roller 54 on the lower end of the tappet is not in engagement with any supporting surface the weight of the filled bottle 28 will cause the tappet 40 to move downwardly to the lowermost position of the tappet, as shown in FIG. 6. The filled bottle 28 will then be released and move from the gripping device 44 and an empty bottle will be engaged by the gripping device whereupon the entire procedure described above will be repeated. The means for reciprocating the vent tube 34 and the cam fingers 56 and 64 can be of any suitable construction. These elements may be operated by any suitable electromechanical, hydraulic or cam operated mechanism in the proper timing sequence relative to the rotation of the head 10. Likewise the operation and timing of the gripping device 44 can be controlled in a similar manner.

Due to the fact that the tappet and the bottles carried thereby are supported completely by a latch pin during the entire filling operation it is totally unnecessary to have an extended guide plate 50 which extends substantially about the entire circumference of the bottle filling machine. It is only necessary to provide a guide plate at the initial portion of the cycle for raising a light weight empty bottle and a light weight tappet to the filling position. As a result the construction of the guide plate does not have to be of heavy duty construction but can be a light weight molded plastic element. After the filling operation is completed the filled bottles are allowed to return to the discharge position entirely under the weight of gravity and by substantially reducing the number of elements necessary for the bottle filling machine to simplify the construction and lower the cost.

While the invention has been particularly shown and described with reference to preferred embodiments thereof it will be understood by those in the art that the foregoing and other changes in form and details may be made therein without departing from the spirit and scope of the invention.

What is claimed is:

1. A bottle filling machine comprising a continuously rotating head having a reservoir therein, a plurality of bottle filling means mounted on said head in controllable communication with said reservoir, a tappet slidably mounted in said head adjacent each bottle filling means, prehensile bottle gripping means secured to the lower end of each tappet for gripping and supporting a bottle, cam means mounted on said bottle filling machine for engagement by said tappet upon rotation of said head to raise said tappet and the bottle carried thereon into filling position in contact with said valve means and latch means selectively engageable with each tappet for maintaining said tappet in the elevated position during the filling operation of each bottle.

2. A bottle filling machine as set forth in claim 1 wherein each tappet is provided with a transverse bore extending therethrough perpendicular to the longitudinal axis of said tappet and said latch means is comprised of a latch pin slidably mounted in said head for horizontal movement into and out of engagement with said bore.

3. A bottle filling machine as set forth in claim 1 wherein said cam means only engages each tappet during the raising operation of each tappet whereby each tappet will be supported only by said latch means once it is moved to its raised bottle filling position.

4. A bottle filling machine as set forth in claim 3 further comprising means on each tappet for engagement with said head to limit the lowering of each tappet under the force of gravity upon release of said latch means.

* * * * *